US012151152B2

(12) United States Patent
Grendal

(10) Patent No.: US 12,151,152 B2
(45) **Date of Patent: *Nov. 26, 2024**

(54) PUNCHWRAP

(71) Applicant: Matthew Grendal, La Jolla, CA (US)

(72) Inventor: Matthew Grendal, La Jolla, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/198,915

(22) Filed: May 18, 2023

(65) Prior Publication Data

US 2023/0285827 A1 Sep. 14, 2023

Related U.S. Application Data

(63) Continuation-in-part of application No. 17/129,122, filed on Dec. 21, 2020, now Pat. No. 11,819,748, which is a continuation-in-part of application No. 29/759,698, filed on Nov. 24, 2020, now Pat. No. Des. 1,002,758, application No. 18/198,915, filed on May 18, 2023 is a continuation-in-part of application No. 29/759,698, filed on Nov. 24, 2020, now Pat. No. Des. 1,002,758.

(60) Provisional application No. 62/964,060, filed on Jan. 21, 2020.

(51) Int. Cl.

| | |
|---|---|
| ***A63B 69/20*** | (2006.01) |
| ***A63B 71/12*** | (2006.01) |
| ***A63B 71/14*** | (2006.01) |

(52) U.S. Cl.

CPC ..... *A63B 69/20* (2013.01); *A63B 71/12* (2013.01); *A63B 71/145* (2013.01); *A63B 2071/1208* (2013.01); *A63B 2210/50* (2013.01); *A63B 2220/53* (2013.01); *A63B 2244/102* (2013.01)

(58) Field of Classification Search

CPC ..... A63B 69/004; A63B 69/26; A63B 69/20; A63B 69/206; A63B 69/28; A63B 69/305; A63B 2071/1208; A63B 71/12; A63B 2210/50; A63B 2244/102; A63B 2220/53

See application file for complete search history.

(56) References Cited

U.S. PATENT DOCUMENTS

| | | | | |
|---|---|---|---|---|
| 1,685,495 | A * | 9/1928 | Latz | A63B 69/30 223/67 |
| 4,667,954 | A * | 5/1987 | McCorkle | A63B 69/26 482/86 |
| 5,501,649 | A * | 3/1996 | Queppet | A63B 69/26 482/88 |
| 6,063,011 | A * | 5/2000 | Pelchat | A63B 69/305 482/90 |
| 8,641,584 | B2 * | 2/2014 | Jang | A63B 71/0669 482/84 |
| 11,351,437 | B2 * | 6/2022 | Song | A63B 69/02 |
| 2010/0130329 | A1 * | 5/2010 | Sullivan | A63B 69/22 482/4 |

(Continued)

*Primary Examiner* — Joshua T Kennedy

(74) *Attorney, Agent, or Firm* — John K Buche; Bryce A. Johnson; The Buche Law Firm, P.C.

(57) ABSTRACT

Disclosed is a punching bag that can transform into body armor for fighter training. The apparatus is to be used as a standalone item that is representative of a heavy bag while also incorporating force sensors and software connectivity for real-time monitoring of speed, power, intensity, or other relevant desired metrics. Further, the apparatus can be adjusted to practice uppercut punches or high kicks by simply moving around a few pieces.

2 Claims, 6 Drawing Sheets

(56) References Cited

U.S. PATENT DOCUMENTS

| | | | | |
|---|---|---|---|---|
| 2011/0159939 | A1* | 6/2011 | Lin | A63B 71/0605 463/8 |
| 2012/0279311 | A1* | 11/2012 | Helmer | F41J 5/056 73/768 |
| 2015/0018174 | A1* | 1/2015 | Partlo | A63B 69/222 482/87 |
| 2017/0036087 | A1* | 2/2017 | Codrington | B32B 9/025 |
| 2017/0189726 | A1* | 7/2017 | Parrish | A61G 1/013 |
| 2017/0319904 | A1* | 11/2017 | Deochand | A63B 69/305 |
| 2019/0314707 | A1* | 10/2019 | Lemieux | A41D 13/0562 |
| 2021/0172975 | A1* | 6/2021 | Song | A63B 71/0605 |
| 2021/0197058 | A1* | 7/2021 | Margareten | A63B 69/32 |
| 2021/0220717 | A1* | 7/2021 | Grendal | A63B 69/20 |
| 2022/0001257 | A1* | 1/2022 | Rolle | A63B 71/14 |
| 2023/0191222 | A1* | 6/2023 | Brush | A63B 24/0062 |

* cited by examiner

PUNCHWRAP

CROSS-REFERENCE TO RELATED APPLICATIONS

This specification is a continuation in part and claims the benefit and priority of U.S. patent application Ser. No. 17/129,122, filed Dec. 21, 2020, which is a divisional of U.S. Des. patent application Ser. No. 29/759,698, filed Nov. 24, 2020.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of mixed martial arts training equipment.

Background of the Invention

Standalone punching bags are a necessity for martial arts training. However, standalone punching bags are heavy, clunky, and not versatile. Thus, a need exists for a standalone punching bag that is modular, light easy to handle, and versatile. Furthermore, a need exists for a punching bag with said properties that also incorporates force sensors and software connectivity such that the bag can provide users with relevant training statistics and metrics while in use and across training sessions. The solution presented to the problem of cumbersome martial arts workout equipment is called a Punchwrap and acts like a heavy bag. The Punchwrap allows users to attach the multiple pieces, each featuring a sensor, including extra padding, to a hook and stand setup or directly to a heavy bag for the same effect. Typically, boxers and MMA fighters purchase a separate upper cut bag and padding for their workout, however, the Punchwrap already includes these items so the user will may not have to purchase extra equipment.

SUMMARY OF THE INVENTION

In view of the foregoing, an object of this specification is to disclose a Punchwrap. The Punchwrap is designed to allow boxers and MMA fighters to practice their punching and kicking techniques without having to use a lot of large equipment. The Punchwrap is to be used as a standalone item that is representative of a heavy bag while also incorporating force sensors and software connectivity for real-time monitoring of speed, power, intensity, or other relevant desired metrics. Further, the Punchwrap can be adjusted to practice uppercut punches or high kicks by simply moving around a few pieces.

The Punchwrap allows users to practice with a trainer and gives the trainer the option to wear a portion of the Punchwrap around their body. Further, the invention allows the trainer to put the body armor over their chest area for more advanced training. The Punchwrap allows the user to put the arm padding on one's hands to simulate a glove work that typical boxers and fighters do with their trainers.

The Punchwrap is travel-friendly. The Punchwrap is lightweight and fits into a compact bag for easy access and portability. The Punchwrap is meant to give the same quality of workout to a person without a gym membership or expensive equipment.

The Punchwrap is modular. The Punchwrap combines two pieces of boxing equipment and has the versatility to become four different pieces of equipment for different techniques. The Punchwrap is an all-in-one home gym that is easily transportable, lightweight, and versatile compared to four separate items which it replaces which are heavy and hard to set up.

The Punchwrap appeals to many different demographics. The Punchwrap may be used by individual athletes and owners of small gyms. Larger gyms may use the Punchwrap outside of their facility, such as in a park, or on a beach.

The Punchwrap provides many benefits to the user. The Punchwrap is light, versatile, and portable. Further it is relatively cheap compared to other martial arts training and exercise equipment. The Punchwrap is designed for home gyms and small or large training sessions. Finally, the Punchwrap can be a heavy punching bag that looks like a sparing vest and, when internal components are removed, it can operate as a sparring vest.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

Figure 1:
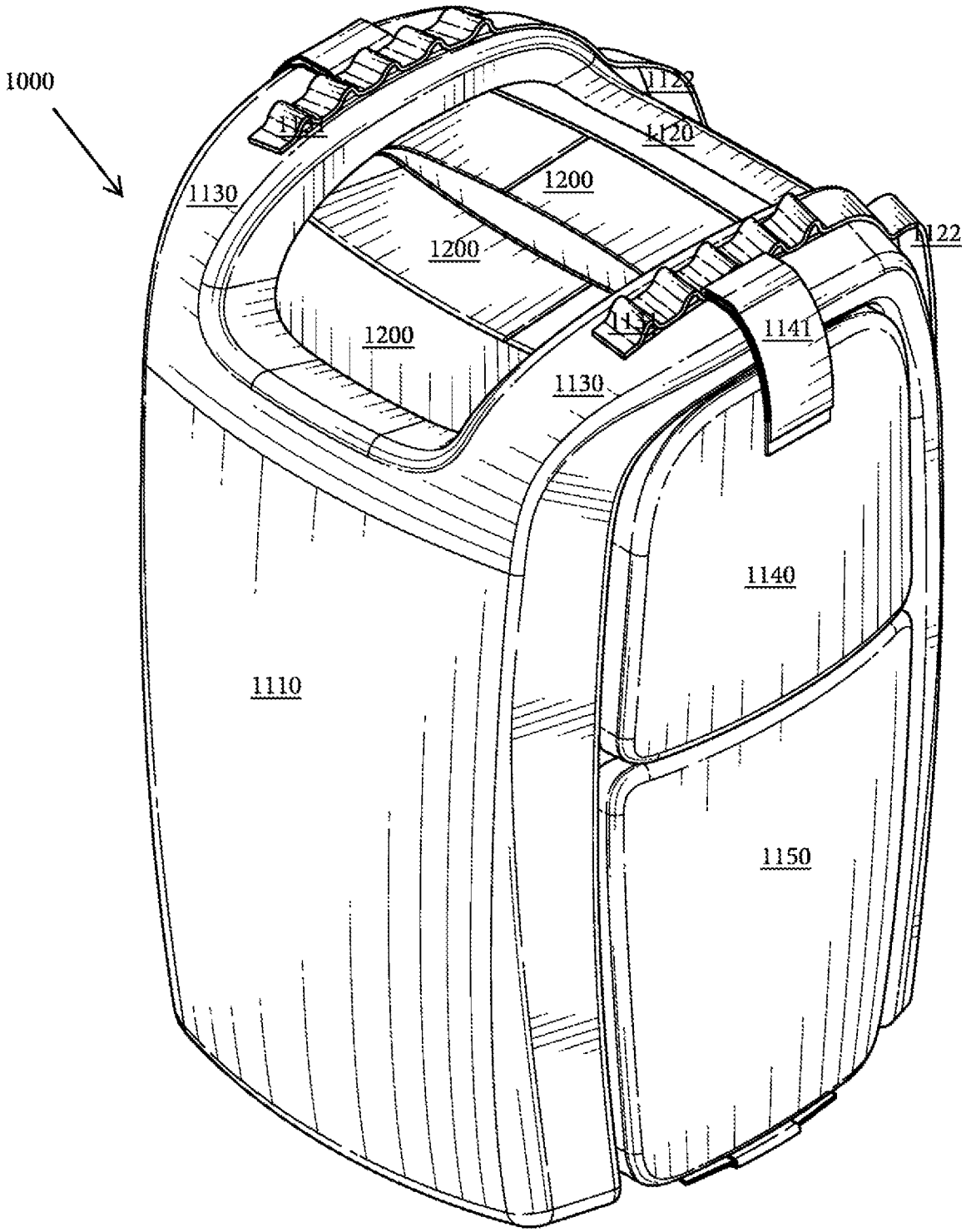
FIG. 1 is a perspective view of a Punchwrap.

The following is a list of characters and their associated structures.

1000—Punchwrap

1100—body padding

1110—front panel

1111—lower front loop

1120—rear panel

1121—lower rear loop

1130—shoulder straps
1131—upper loops
1140—shoulder pads or another set of side pads
1141—connectors
1150 side pads
1200—hand pads
1300—arm pads or double ended punching bag It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Disclosed is a training device, called a Punchwrap, that can transform from a punching bag to a set of body and arm padding which can be used in multiple ways for different training techniques. When using the Punchwrap, the user may in one mode connect the two-fold a body or arm padding to form a cylindrical item, creating a heavy punching bag. In some versions, there are a few different attachments that unhooks to create an uppercut bag. In other versions, the Punchwrap can be used with a standard heavy bag stand by placing the cylinder on the hook and anchoring it to the ground with chords attached to a ground weight; this version of the Punchwrap may also be used in a similar manner another system that allows for the Punchwrap to be suspended in the air, similar to a traditional hanging heavy bag, and anchoring it to the ground via a suitable means such as rope, string, elastic bands, or other method.

Figure 2:
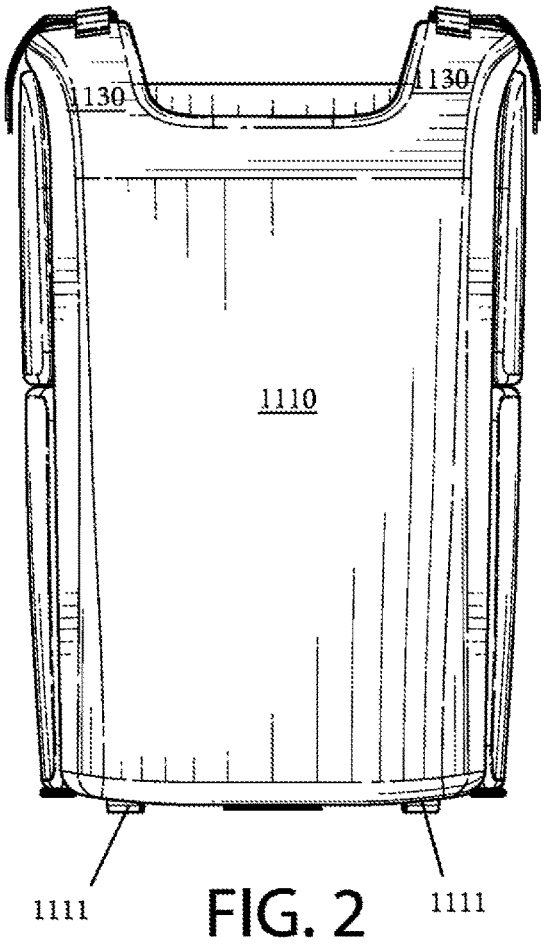
FIG. 2 is a front view of the Punchwrap of FIG. 1.
Figure 3:
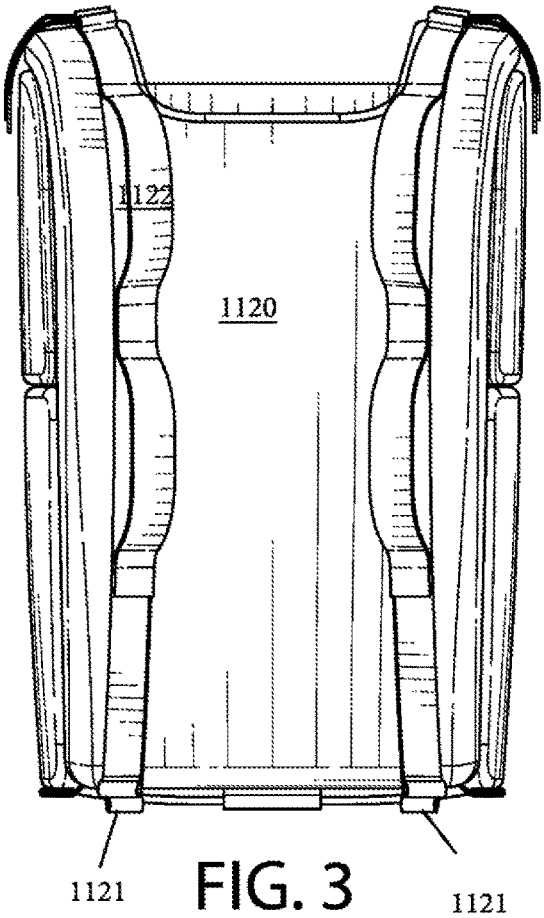
FIG. 3 is a rear view of the Punchwrap of FIG. 1.
Figure 4:
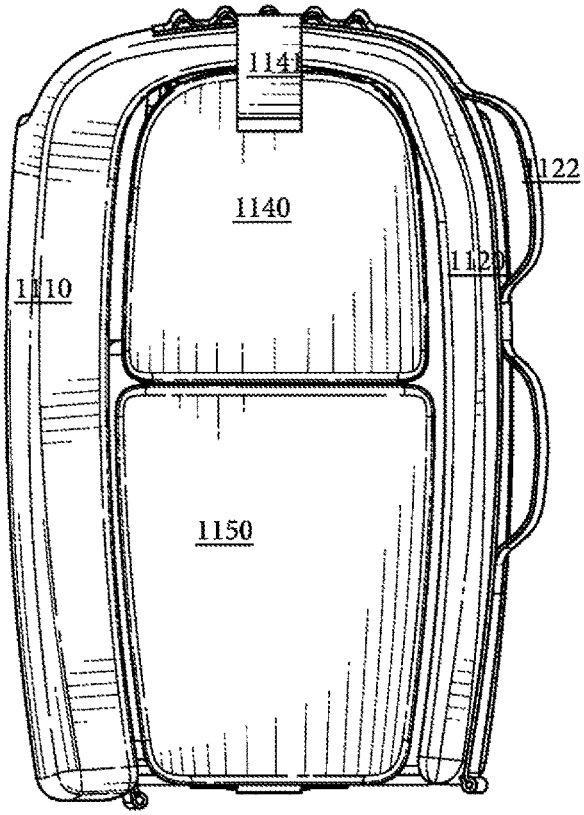
FIG. 4 is a left-side view of the Punchwrap of FIG. 1.
Figure 5:
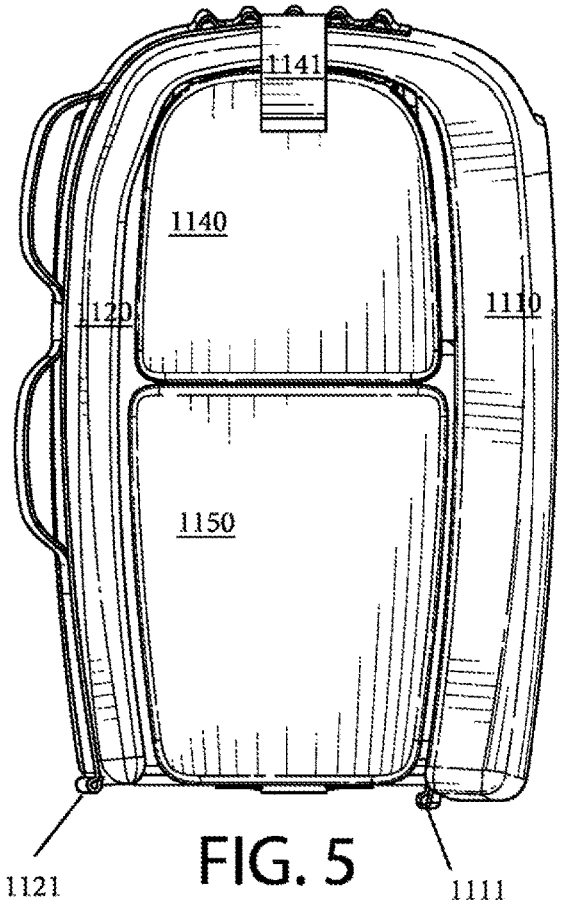
FIG. 5 is a right-side view of the Punchwrap of FIG. 1.
Figure 6:
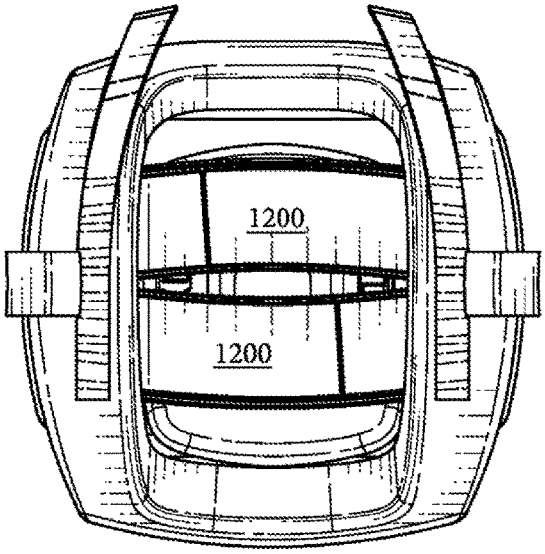
FIG. 6 is a top view of the Punchwrap of FIG. 1.
Figure 7:
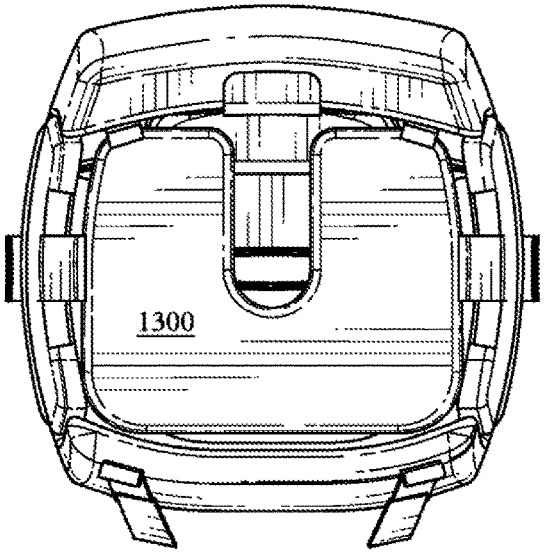
FIG. 7 is a bottom view of the Punchwrap of FIG. 1.

This disclosed subject matter takes popular pieces of fight training equipment and combines them into one manageable system. A typical heavy bag can weigh anywhere from 70 to 150 lbs and can be hard to transport and setup, whereas the Punchwrap is lightweight and compact. Uppercut bags are permanent fixtures, typically bolted into the wall, whereas the Punchwrap can become an uppercut bag using a common gym bag as an attachment. In a preferred embodiment, the arm padding can be put on the Punchwrap to form an uppercut bag; however, in alternate embodiments the Punchwrap's arm padding may instead be configured to be mountable or able to attach to a separate stand, wall mount, or other similar suitable attachment point. The Punchwrap includes detachable training mitts and body armor that can be used separately or with the other attachments to create a portable heavy bag. The Punchwrap can be converted to an upper cut bag or have its parts used as a double end punching bag. The Punchwrap may give both professional fighters and individuals looking for a different type of workout the opportunity to have a full training experience, by themselves or with a partner. The Punchwrap's individual pads and pieces all contain electronic pressure sensors with software connectivity, such that the Punchwrap gives a user the option of seeing their real-time metrics projected onto a nearby computer screen or smartphone app. The details of the Punchwrap are disclosed with reference to the figures, wherein the following is a list of characters and their associated structures:

FIG. 1 is a perspective view of one configuration of the Punchwrap 1000. FIG. 2 is a front view of the Punchwrap 1000. FIG. 3 is a rear view of the Punchwrap 1000. FIG. 4 is a left-side view of the Punchwrap 1000. FIG. 5 is a right-side view of the Punchwrap 1000. FIG. 6 is a top view of the Punchwrap 1000. FIG. 7 is a bottom view of the Punchwrap 1000. As shown, the Punchwrap 1000 externally features body padding (1100 FIG. 8) defined by: a front panel 1110 with lower front loops 1111; side pads or panels 1150; a rear panel 1120 defined by back straps 1122 and lower rear loops 1121; shoulder straps 1130 that connect the front and rear panels 1110, 1120 and that feature upper loops 1131; shoulder pads 1140 are hung off the straps 1130 via a connector 1141. The Punchwrap 1000 internally features hand pads 1200 and arm pads 1300 that are disposed between the front and rear pads 1110, 1120. Furthermore, the Punchwrap's 1000 various pads as listed above internally feature pressure sensors and or gyroscopes capable of tracking pressure or movement such that an algorithm may be employed to determine a users speed, power, punch count, calories lost, and intensity during use and connect to software or similar application which can broadcast the current training metrics through a connected screen, such as a computer or casting to a television, and track user metrics over multiple training sessions to provide averages and overall trends. Suitably, the hand and arm pads 1200, 1300 fit snugly inside the body padding (1100 FIG. 8) so that the Punchwrap 1000 has an appearance and feel of solidarity of parts. Preferably, each part or padding of the body padding (1100 FIG. 8) and internal parts (hand and arm pads 1200, 1300) features foam or other padded material and or weighted material as would be common to fighting gear and regular well-known punching bags.

In the configuration shown in FIGS. 1 through 7, the Punchwrap can be used as a punching bag. In one mode of use trainer may grip the handles 1122 on the rear pad 1120 and simply hold the Punchwrap 100 in front of a fighter. From this lifted position, the fighter may strike the Punchwrap 1000 in the front 1110 or side panels 1150 using his feet or hands. Additionally, the fighter may punch arm padding 1300 that is exposed on the underside of the Punchwrap 1000 (as shown in FIG. 7). In some oases, the Punchwrap 1000 may have the hand or arm pads (1200, 1300) connected externally to the front panel to convert the Punchwrap 1000 into an uppercut specific punching bag; in this particular uppercut specific configuration, the Punchwrap is suitably turned pride down so that the arm pads are located at an upper location such that they are in each for an uppercut punching motion.

Figure 8:
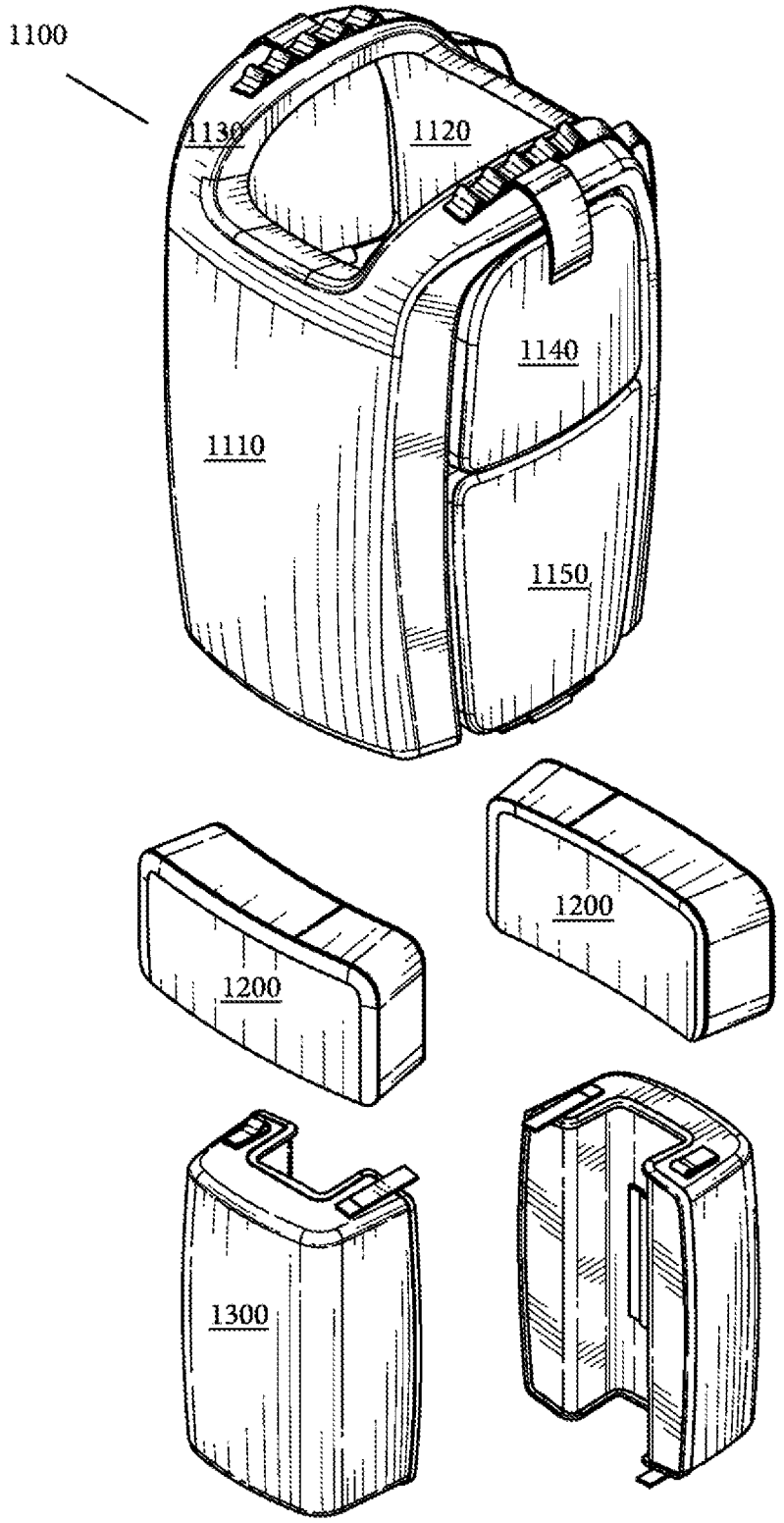
FIG. 8 is an exploded view of the Punchwrap of FIG. 1.
Figure 8A:
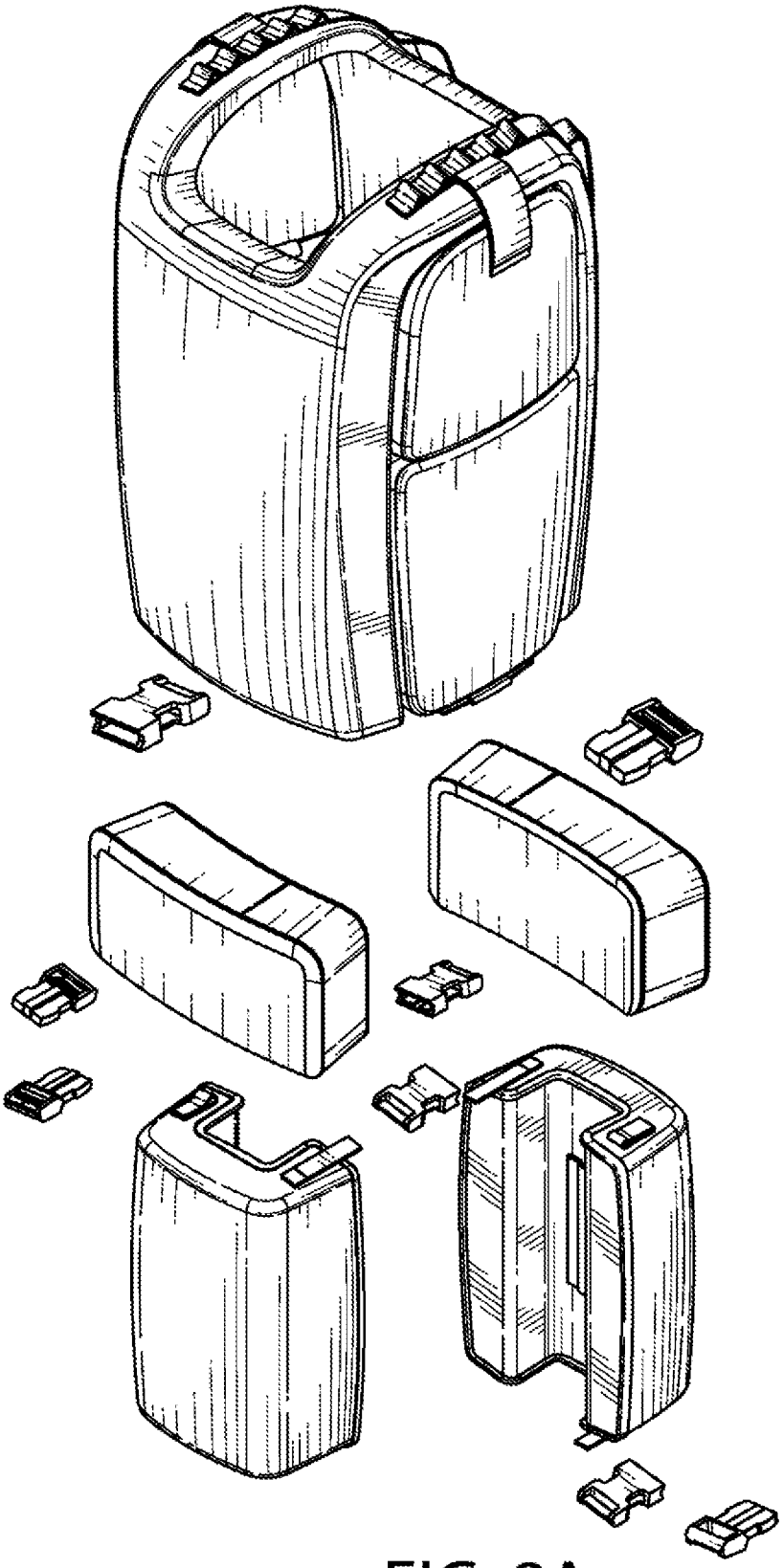
FIG. 8A is an alternate exploded view of the Punchwrap of FIG. 1.

FIGS. 8 and 8A are an exploded view of the Punchwrap 1000. As shown, hand pads 1200 and the arm pads 1300 are preferably disposed within the body padding 1100 of the Punchwrap 1000. As shown in FIG. 8A the hand pads and arm pads may be clipped into position within the body padding 1100. Other forms of attachment, like Velcro® (hook and loop fastener), snaps, buttons, zippers, or the like could also be used to secure the Punchwrap 1000 into a punching bag configuration shown in FIGS. 1 through 7.

In a preferable embodiment, the Punchwrap 1000 has standard-use pressure sensors in the interior of each of the various pads; the sensors are similar to digital force sensors which would typically be found in a bag used in connection with high intensity training which requires accurate force measurement. The sensors connect to a computer or smartphone and have the ability to send real-time data and metrics to the connected device; during use, when connected, the Punchwrap 1000 can show a user the current punching or kicking speed, power, intensity, and other related metrics. Additionally, in a preferred embodiment, the Punchwrap's 1000 sensors can allow metrics to be tracked over time and presented to a user in the form of a graph, averages over time intervals or over a course of use sessions, highest-tracked values, or other similar statistics that may be desired. The sensors included in this embodiment of the Punchwrap 1000 allows a user to visualize theft improvement over time, even across a single training session, because of the connectivity.

Figure 9:
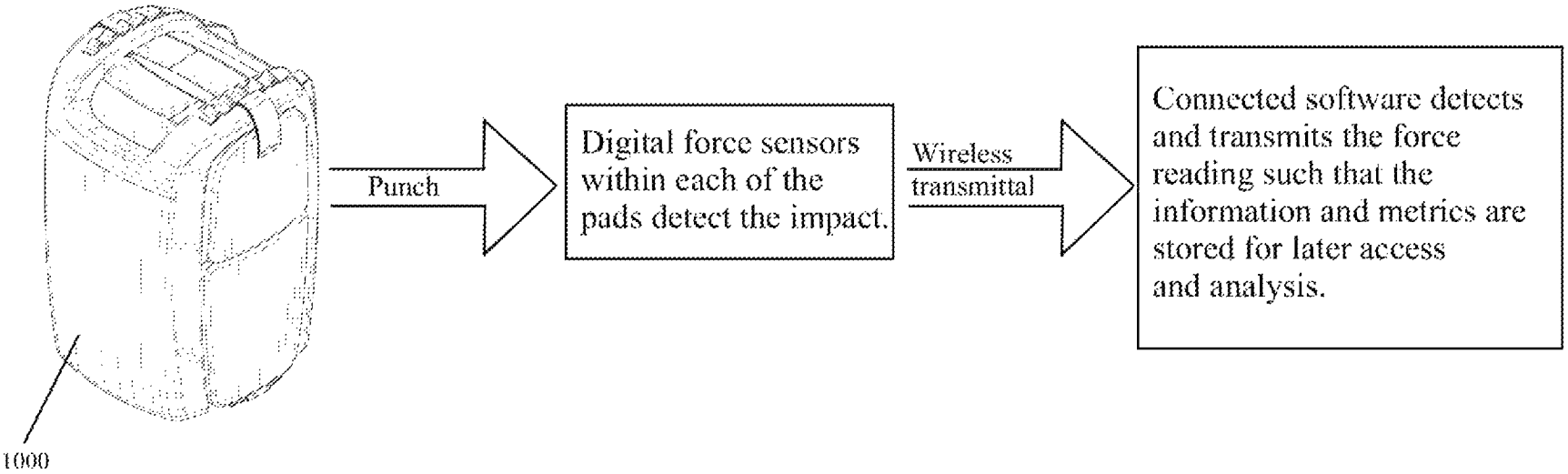
FIG. 9 is a flow chart.

FIG. 9 is a perspective view of the Punchwrap as a heavy bag. As shown, the Punchwrap can be used as a heavy punching bag by securing cords 2000 to the upper loops 1131 of the shoulder straps 1131 and to the lower loops 1111, 1121 of the front and rear panels 1110, 1120. The cords 200 can be strung between a ceiling, the Punchwrap 1000, and the floor. In one mode of use trainer may grip the handles 1122 to give it weight or tie or hook up or arm pads 1300 on the handles 1122 of the rear pad 1120. From this lifted position, the fighter may strike the Punchwrap 1000 in the front 1110 or side panels 1150 using his feet or hands. Additionally, the fighter may punch arm padding 1300 that is exposed on the underside of the Punchwrap 1000 (as shown in FIG. 7).

The figures illustrate how individual could wear the body padding 1100 as a training vest or body armor. As shown, the shoulder pads 1140 may be pivoted around the connector 1141 to form a shoulder pad and then a user could slip on the body padding 1100 like any shirt or jersey. The hand pads may be held in each hand for targeted punching while the arm padding can be worn on the forearms or shins of the trainer wearing the body harms. In the figures, arm padding which is used to form the cylinder, as well as, a standalone item. Suitably, the assembled arm padding. As shown in the figures, the arm padding forms a cylinder which may be used as a double ended punching bag. More specifically, the arm pads could be strung up with straps, as shown in the figures, to accomplish a double ended punching bag.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus, the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refer, to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should trot be construed as mandating a particular architecture or configuration.

All original claims submitted with this specification are incorporated by reference in their entirety as if fully set forth herein.

I claim:

1. A punching bag comprising:

body padding defined by:

a front panel with lower front loops;

side pads;

a rear panel with back straps and lower rear loops;

shoulder straps that connect the front and rear panels and that further feature upper loops; and shoulder pads hung off the straps via a connector;

wherein the body padding internally features hand pads and arm pads that are configured to be removably disposed between the front and rear pads such that the hand and arm pads fit snugly inside the body padding.

2. The punching bag of claim 1 wherein the front panel, side pads, rear panel, hand pads, and arm pads all internally contain digital force sensors wherein said force sensors have the ability to connect to a computer or smartphone application such that training metrics may be tracked over a single session or over time.

* * * * *